US010760537B2

(12) United States Patent
Kimura et al.

(10) Patent No.: US 10,760,537 B2
(45) Date of Patent: Sep. 1, 2020

(54) AIR CLEANER

(71) Applicant: TOYOTA BOSHOKU KABUSHIKI KAISHA, Aichi-ken (JP)

(72) Inventors: Ryusuke Kimura, Ichinomiya (JP); Yoshinori Inuzuka, Nishio (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 487 days.

(21) Appl. No.: 15/663,146

(22) Filed: Jul. 28, 2017

(65) Prior Publication Data

US 2018/0058397 A1 Mar. 1, 2018

(30) Foreign Application Priority Data

Aug. 29, 2016 (JP) ..... 2016-167242

(51) Int. Cl.
*F02M 35/024* (2006.01)
*E04B 1/84* (2006.01)

(52) U.S. Cl.
CPC ..... *F02M 35/02466* (2013.01); *E04B 1/84* (2013.01); *F02M 35/02491* (2013.01); *F02M 35/02433* (2013.01)

(58) Field of Classification Search
None
See application file for complete search history.

(56) References Cited

U.S. PATENT DOCUMENTS 7,000,583 B2 * 2/2006 Kino ..... F02M 35/14 123/184.53
7,967,106 B2 * 6/2011 Ross ..... F02M 35/1266 123/184.53
2004/0118371 A1 6/2004 Kino et al.
2004/0226531 A1 11/2004 Kino et al.
2005/0173186 A1 * 8/2005 Kino ..... F02M 35/1216 181/250
2006/0272509 A1 12/2006 Uemura et al.
(Continued)

FOREIGN PATENT DOCUMENTS

DE 10322168 12/2003
JP 8-152890 6/1996
(Continued)

OTHER PUBLICATIONS

U.S. Appl. No. 15/663,105 to Ryusuke Kimura et al., filed Jul. 28, 2017.
(Continued)

*Primary Examiner* — Amber R Orlando
(74) *Attorney, Agent, or Firm* — Greenblum & Bernstein, P.L.C.

(57) ABSTRACT

An air cleaner has a first housing having an inlet and an upper opening, a second housing having an outlet and a lower opening, a filter element arranged between the upper opening of the first housing and the lower opening of the second housing. The first housing includes a looped wall, which protrudes from the inner surface thereof, and a sound absorbing member, which is made of an air permeable material and fixed to the upper end of the looped wall. The inner surface of the first housing, the inner peripheral surface of the looped wall, and the sound absorbing member define an air chamber.

6 Claims, 3 Drawing Sheets

(56) References Cited

U.S. PATENT DOCUMENTS

| | | | | |
|---|---|---|---|---|
| 2008/0257346 | A1* | 10/2008 | Lathrop | A61M 16/0066 128/204.17 |
| 2013/0161124 | A1* | 6/2013 | Neumann | F01N 13/007 181/228 |
| 2016/0325218 | A1* | 11/2016 | Hasegawa | B01D 46/0005 |

FOREIGN PATENT DOCUMENTS

| | | |
|---|---|---|
| JP | 2000-110682 | 4/2000 |
| JP | 2002-266715 | 9/2002 |
| JP | 2003-227427 | 8/2003 |
| JP | 10322168 | 12/2003 |
| JP | 2006-342684 | 12/2006 |

OTHER PUBLICATIONS

Chinese Office Action in Chinese patent application No. 201710737514.9 dated Jun. 5, 2019, along with English translation thereof.

German Office Action issued in German Patent Application No. 10 2017 119 339.1 dated Dec. 23, 2019, along with English translation thereof.

Office Action in Japanese patent application No. JP2016-167242 dated Feb. 4, 2020, along with English language translation.

* cited by examiner

AIR CLEANER

BACKGROUND OF THE INVENTION

The present invention relates to an air cleaner for filtering air supplied to an internal combustion engine.

An air cleaner for an internal combustion engine has a first housing having an inlet and an opening, a second housing having an outlet and an opening, a filter element arranged between the opening of the first housing and the opening of the second housing.

In the air cleaner described in Japanese Laid-Open Patent Publication No. 2000-110682, the inner surface of the first housing is in contact with an entire opposed surface of a sound absorbing member made of a porous material such as foamed plastic. The sound absorbing member reduces the intake noise.

However, in the above-described air cleaner, the effect of reduction of the intake noise by the sound absorbing member is limited and there is room for improvement.

SUMMARY OF THE INVENTION

An objective of the present invention is to provide an air cleaner capable of effectively reducing intake noise.

To achieve the foregoing objectives and in accordance with one aspect of the present invention, an air cleaner is provided that includes a first housing including an inlet and an opening, a second housing including an outlet and an opening, and a filter element arranged between the opening of the first housing and the opening of the second housing. At least one of the first housing and the second housing includes a looped fixing rib, which protrudes from an inner surface thereof, and a sound absorbing member, which is made of an air permeable material and fixed to an upper end of the fixing rib. The inner surface of the at least one of the housings, an inner peripheral surface of the fixing rib, and the sound absorbing member define an air chamber.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An air cleaner according to one embodiment will now be described.

Figure 1:
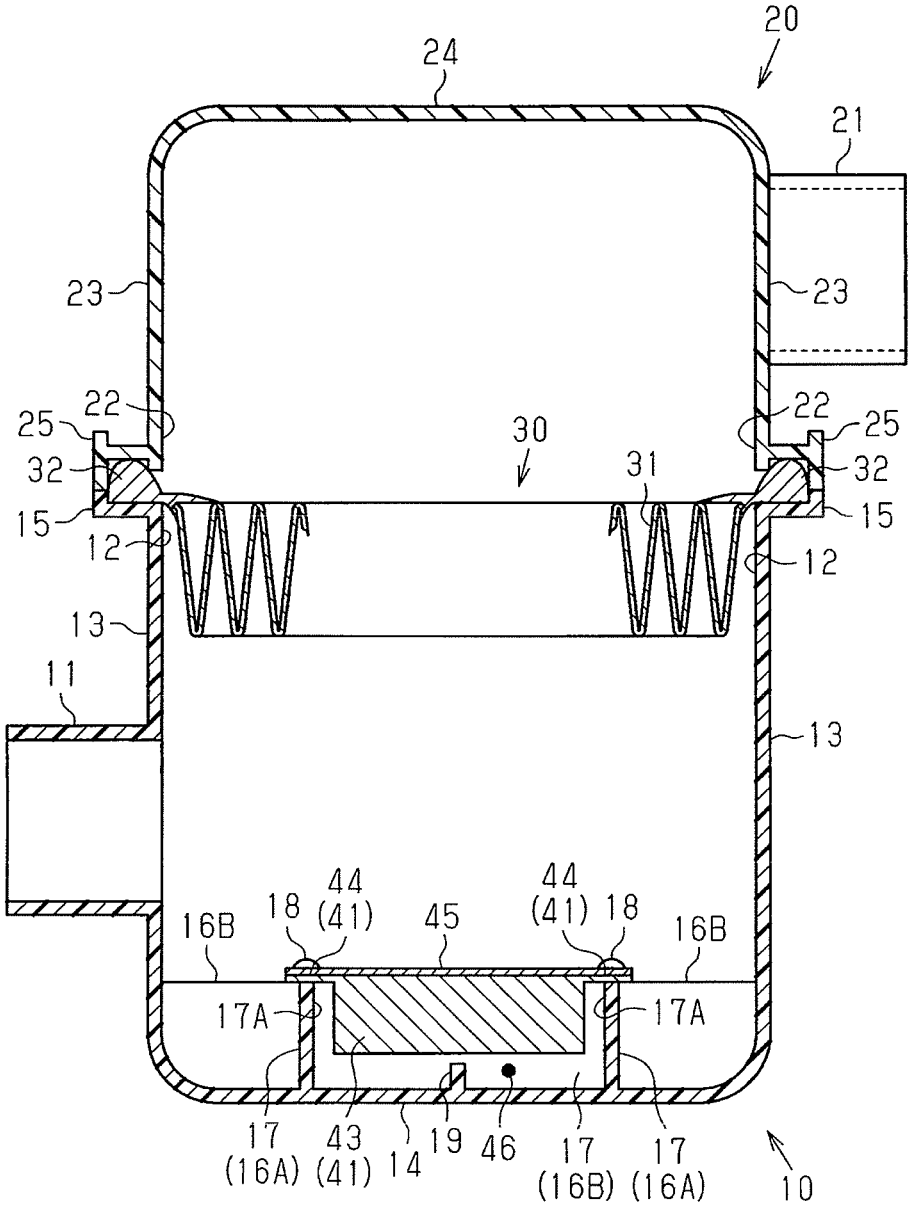
FIG. 1 is a cross-sectional view showing an air cleaner according to one embodiment.

An air cleaner shown in FIG. 1 is arranged in an intake passage of a vehicle-mounted internal combustion engine and includes a first housing 10 having a cylindrical inlet 11 and a second housing 20 having a cylindrical outlet 21.

Figure 2:
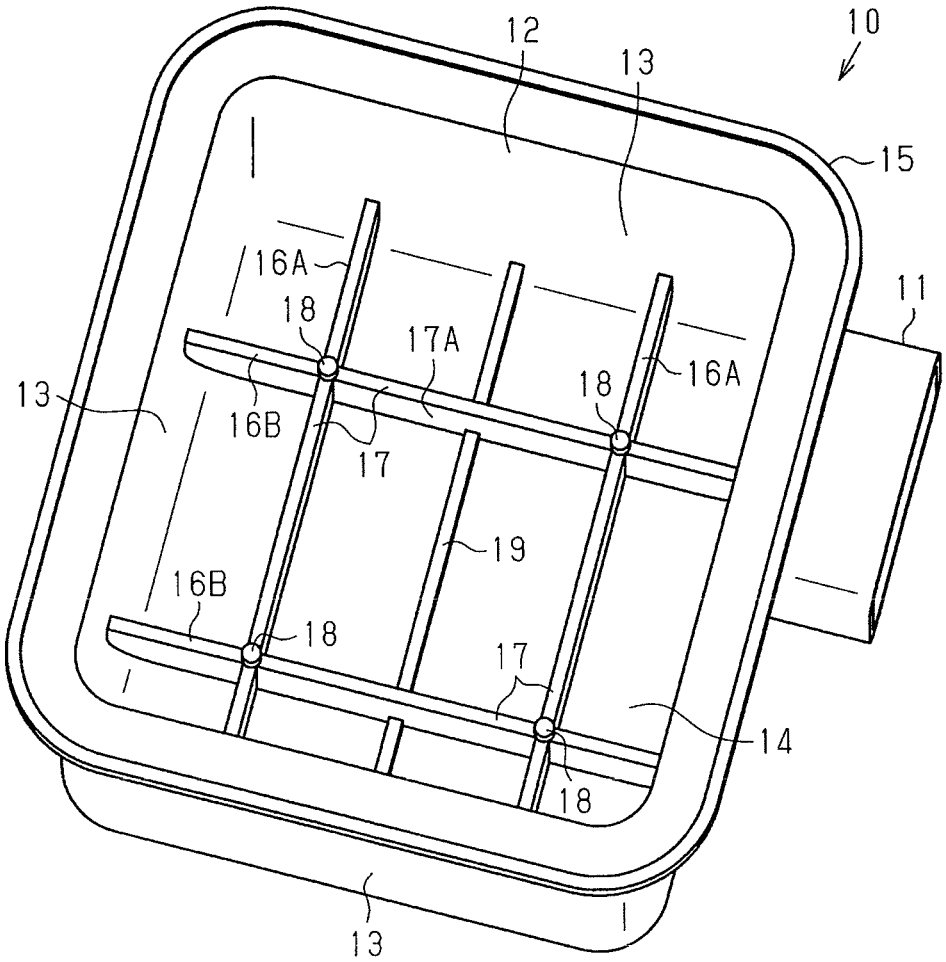
FIG. 2 is a perspective view showing the first housing of the embodiment.

As shown in FIGS. 1 and 2, the first housing 10 includes an upper opening 12, a peripheral wall 13, which surrounds the upper opening 12, and a bottom wall 14. An outward extending flange 15 is provided around the entire periphery of the upper opening 12. The inlet 11 protrudes from the outer surface of the peripheral wall 13. The first housing 10 is made of a hard synthetic plastic.

As shown in FIG. 1, the second housing 20 includes a lower opening 22, a peripheral wall 23, which surrounds the lower opening 22, and a top wall 24. An outward extending flange 25 is provided around the entire periphery of the lower opening 22. The outlet 21 protrudes from the outer surface of the peripheral wall 23. The second housing 20 is made of a hard synthetic plastic.

A filter element 30 is arranged between the upper opening 12 of the first housing 10 and the lower opening 22 of the second housing 20. The filter element 30 has a filtration portion 31 and a loop-shaped sealing portion 32. The filtration portion 31 is formed by pleating a filtering medium sheet of filter paper or nonwoven fabric, and the sealing portion 32 is provided at the outer periphery of the filtration portion 31.

In the air cleaner, the sealing portion 32 of the filter element 30 is held by the flange 15 of the first housing 10 and the flange 25 of the second housing 20. The sealing portion 32 seals the gap between the first housing 10 and the second housing 20.

A vibration reducing structure for reducing intake noise is arranged on the bottom wall 14 of the first housing 10. The vibration reducing structure will now be described.

As shown in FIGS. 1 and 2, fixing ribs 16A, 16B protrude from the inner surface of the bottom wall 14 of the first housing 10. The fixing ribs 16A and 16B are composed of two fixing ribs 16A extending parallel with each other and two fixing ribs 16B extending parallel with each other in a direction orthogonal to the fixing ribs 16A. The fixing ribs 16A and 16B are arranged to form a lattice shape on the entire bottom wall 14 of the first housing 10. As shown in FIG. 2, columnar fixing portions 18 are formed so as to protrude from the parts where the fixing ribs 16A, 16B intersect, that is, from the corners of the looped rectangle formed by the fixing ribs 16A, 16B (hereinafter referred to as a looped wall 17).

Also, as shown in FIGS. 1 and 2, a reinforcing rib 19 protrudes from the inner surface of the bottom wall 14 of the first housing 10. The reinforcing rib 19 is located between the two fixing ribs 16A and extends in parallel with the fixing ribs 16A. The height of the reinforcing rib 19 (the amount of protrusion from the bottom wall 14) is set to be lower than the height of the fixing ribs 16A, 16B.

Figure 3:
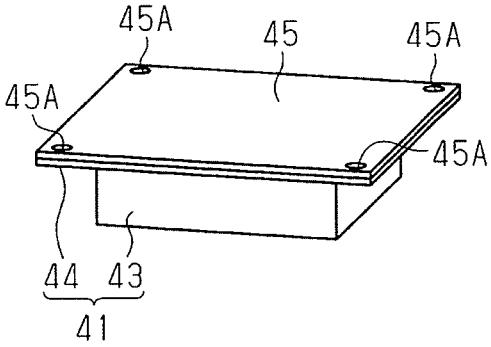
FIG. 3 is a perspective view showing the sound absorbing member and the covering layer of the embodiment.

As shown in FIGS. 1 and 3, a sound absorbing member 41 made of nonwoven fabric is installed in the first housing 10. The sound absorbing member 41 is arranged to block the upper opening 17A, which is surrounded by the looped wall 17.

The sound absorbing member 41 has a rectangular plate-shaped sound reducing portion 43 and a flange 44, which is formed on the entire periphery of the upper end of the sound reducing portion 43 and has a rectangular looped shape in a plan view. The nonwoven fabric sheet constituting the sound absorbing member 41 is composed of known sheath-core type conjugate fiber including cores made of, for example, polyethylene terephthalate (PET) fiber and sheaths made of modified PET having a melting point lower than that of the PET fiber of the cores (neither is illustrated). The sound absorbing member 41 is formed integrally by hot pressing the nonwoven fabric sheet. In the forming of the sound absorbing member 41, the degree of compression of the peripheral portion (the flange 44) of the sound absorbing member 41 is set to be greater than the degree of compression of the central portion (the sound reducing portion 43) of the sound absorbing member 41. As a result, the air permeability of the flange 44 (substantially 0 in the present embodiment) is lower than the air permeability of the sound reducing portion 43. The flange 44, which has a rectangular looped shape in a plan view, has a through-hole (not shown) in each of the four corners.

A covering layer 45 is fixed to the upper surface of the sound absorbing member 41. The covering layer 45 has a rectangular shape in a plan view and covers the entire upper surface of the sound absorbing member 41. The nonwoven fabric sheet constituting the covering layer 45 is composed of main fibers made of PET and binder fibers that are made of polypropylene (PP) and bind the main fibers together. The air permeability of the covering layer 45 is set to be lower than that of the sound reducing portion 43 of the sound absorbing member 41. Specifically, the air permeability of the covering layer 45 is preferably 3 $cm^3/cm^2 \cdot s$ to 50 $cm^3/cm^2 \cdot s$ and is set to 10 $cm^3/cm^2 \cdot s$ in the present embodiment. The air permeability of the covering layer 45 is measured by a measuring method in which a Frazier-type tester specified in JIS. L. 1096, A-method is used. The covering layer 45, which has a rectangular shape in a plan view, has a through-hole 45A in each of the sections that correspond to the through-holes of the sound absorbing member 41 at the corners.

The sound absorbing member 41 and the covering layer 45 are fixed to the first housing 10 in the following manner.

Figure 4:
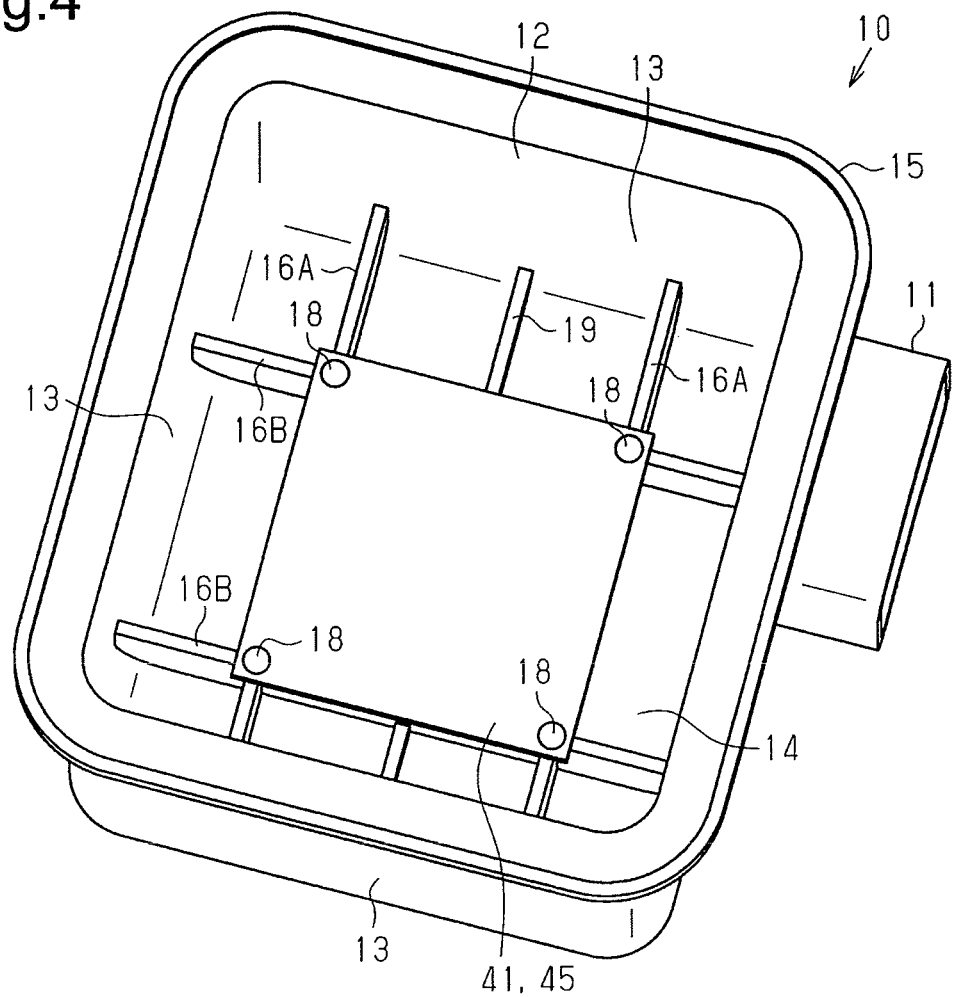
FIG. 4 is a perspective view of the first housing of the embodiment, illustrating a state in which the sound absorbing member and the covering layer are fixed.

First, as shown in FIGS. 2 to 4, the fixing portions 18 on the upper surface of the looped wall 17 of the first housing 10 are inserted through the through-holes of the sound absorbing member 41 and the through-holes 45A (FIG. 3) of the covering layer 45. Accordingly, the sound absorbing member 41 and the covering layer 45 are in a state of closing the upper opening 17A of the looped wall 17 (the state shown in FIG. 1). In this state, the ends of the fixing portions 18 (specifically, the portions protruding above the covering layer 45) are thermally swaged. In this way, the sound absorbing member 41 and the covering layer 45 are fixed to the upper end of the looped wall 17.

By fixing the sound absorbing member 41 and the covering layer 45 in the above-described manner, the inner surface of the bottom wall 14, the inner peripheral surface of the looped wall 17, and the lower surface of the sound absorbing member 41 define an air chamber 46 (FIG. 1) in the first housing 10. In the air cleaner of the present embodiment, the sound absorbing member 41 does not contact the reinforcing rib 19.

Operation of the present embodiment will now be described.

When the wave of intake noise traveling inside the air cleaner collides with the covering layer 45, the covering layer 45 is pushed, and the sound absorbing member 41 and the air in the air chamber 46 act like a spring, so that the covering layer 45 vibrates. Then, the vibration of the covering layer 45 and the vibration of the sound absorbing member 41, which is integral with the covering layer 45, are converted into thermal energy, so that the intake noise is reduced.

The lower the air permeability of the covering layer 45, the lower becomes the frequency at which the covering layer 45 resonates. It is thus possible to effectively reduce the sound pressure level of lower frequency components of the intake noise. In the air cleaner of the present embodiment, the covering layer 45, which is made of a material having a lower air permeability than the sound absorbing member 41, is provided to cover the entire surface of the sound absorbing member 41. It is thus possible to effectively reduce the sound pressure level of low frequency components as compared with an air cleaner lacking the covering layer 45.

In the air cleaner of the present embodiment, the air permeability of the portion sandwiched between the covering layer 45 and the peripheral portion (the flange 44) of the sound absorbing member 41, that is, the upper end of the looped wall 17 of the sound absorbing member 41 is set low. Thus, when the covering layer 45 vibrates, air is prevented from leaking from or entering into the air chamber 46 through between the covering layer 45 and the looped wall 17. As a result, the covering layer 45 easily vibrates, and the vibration is easily converted into thermal energy, so that the intake noise is effectively reduced.

Further, some of the wave of the intake noise passes through the covering layer 45 and the sound absorbing member 41 (more specifically, the sound reducing portion 43). When passing through the sound absorbing member 41, the intake noise vibrates the sound absorbing member 41 and the air in the gaps in the sound absorbing member 41. The resultant friction converts the vibration energy into thermal energy, which reduces the vibration and the intake noise.

Even if a covering layer is provided on the surface of the sound absorbing member 41 on the inner side of the air chamber 46 (the surface on the lower side in FIG. 1, hereinafter referred to as the inner surface of the sound absorbing member 41), the covering layer vibrates due to the intake noise passes through the sound absorbing member 41 and reaches the covering layer. The sound pressure level of low frequency components thus can be reduced. In this case, however, part of the intake noise that contains low frequency components is reflected by the surface of the sound absorbing member 41 and returns into the air cleaner before reaching the covering layer, so that the sound pressure level of low frequency components are less effectively reduced. In this respect, in the air cleaner of the present embodiment, the covering layer 45 is provided on the surface of the sound absorbing member 41 on the outer side of the air chamber 46 (the surface on the upper side in FIG. 1, hereinafter referred to as the outer surface of the sound absorbing member 41). Thus, all the sound of low frequency components first enter the covering layer 45. Therefore, it is possible to restrain sound of low frequency components from being reflected without reducing the sound pressure level. This effectively reduces the sound pressure level of low frequency components reflected by the sound absorbing member 41 and the covering layer 45.

Figure 5:
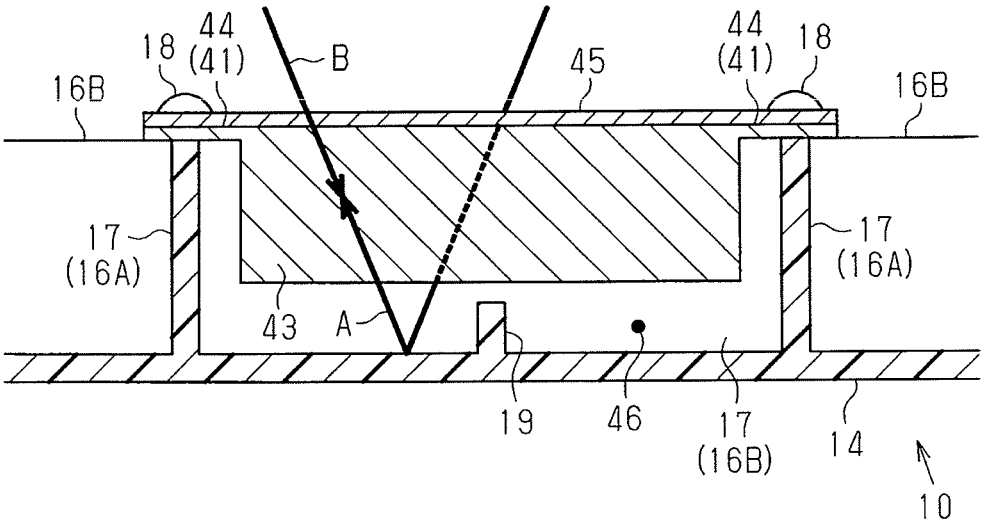
FIG. 5 is a cross-sectional view showing the air chamber and its surroundings of the embodiment.

Also, as shown in FIG. 5, the wave of intake noise that has entered the air chamber 46 after passing through the covering layer 45 and the sound absorbing member 41 is reflected by the inner surface of the first housing 10 and returns to the sound absorbing member 41. In the air cleaner of the present embodiment, the intake noise that is reflected and returns to the sound absorbing member 41 in this way (the reflected wave indicated by arrow A in FIG. 5) and the intake noise that enters the sound absorbing member 41 from the outside of the air chamber 46 (the incident wave indicated by arrow B in FIG. 5) are caused to interfere with each other, so that the intake noise can be reduced.

In the air cleaner of the present embodiment, the air chamber 46 is defined between the inner surface of the first housing 10 and the sound absorbing member 41. Thus, unlike an air cleaner lacking the air chamber 46, it is possible to change the distance traveled by the intake noise until it returns to the sound absorbing member 41 after passing through the sound absorbing member 41 and being reflected. In the air cleaner of the present embodiment, based on the results of various experiments and simulations, the shape of the air chamber 46 is determined such that the above distance is a length that causes part of the incident wave of the intake noise and part of the reflected wave to be in opposite phases. Therefore, according to the air cleaner of the present embodiment, it is possible to effectively reduce the intake noise by canceling out the incident wave and the reflected wave of the intake noise.

Furthermore, the air cleaner of the present embodiment includes, in the air chamber 46, the reinforcing rib 19, which protrudes from the inner surface of the bottom wall 14 of the first housing 10 and has the upper end separated from the lower surface of the sound absorbing member 41. As a result, the vibration reducing structure, which is constituted by the fixing ribs 16A, 16B, the sound absorbing member 41, and the covering layer 45, is provided on the inner surface of the first housing 10. Also, a reinforcing rib is arranged on the portion of the vibration reducing structure so as not to interfere with the vibration of the sound absorbing member 41 and the covering layer 45. Therefore, it is possible to prevent the stiffness of the first housing 10 from being reduced due to the disposition of the vibration reducing structure.

As described above, the present embodiment achieves the following advantages.

(1) When passing through the sound absorbing member 41, the intake noise vibrates the air in the gaps in the sound absorbing member 41. The resultant friction converts the vibration energy into thermal energy, which reduces the vibration and the intake noise. Moreover, the incident wave of the intake noise entering the sound absorbing member 41 from the outside of the air chamber 46 is caused to interfere with (cancel out) the reflected wave of the intake noise that enters the air chamber 46 after passing through the sound absorbing member 41, is reflected by the inner surface of the first housing 10, and returns to the sound absorbing member 41. This also reduces the intake noise. As described above, the air cleaner of the present embodiment is capable of effectively reducing intake noise.

(2) The covering layer 45, which is made of a material having a lower air permeability than the sound absorbing member 41, is provided to cover the entire outer surface of the sound absorbing member 41. It is thus possible to effectively reduce the sound pressure level of low frequency components as compared with an air cleaner lacking the covering layer 45.

(3) The air permeability of the flange 44 of the sound absorbing member 41 is lower than the air permeability of the sound reducing portion 43, and the flange 44 is fixed to the upper end of the looped wall 17. As a result, the covering layer 45 easily vibrates, and the vibration is easily converted into thermal energy, so that the intake noise is effectively reduced.

(4) The reinforcing rib 19, which is provided in the air chamber 46, protrudes from the inner surface of the bottom wall 14 of the first housing 10 and has an upper end separated from the sound absorbing member 41. Therefore, it is possible to prevent the stiffness of the first housing 10 from being reduced due to the disposition of the vibration reducing structure.

<Modifications>

The above illustrated embodiment may be modified as follows.

The sound absorbing member 41 does not necessarily need to be made of nonwoven fabric, but it may be made of a porous material such as a foamed plastic (for example, foamed polyurethane).

The reinforcing rib 19 may be omitted. In addition, portions other than the looped wall 17 may be omitted from the fixing ribs 16A and 16B.

The flange 44 of the sound absorbing member 41 may be adhered and fixed to the upper end of the looped wall 17 so as to seal the entire circumference between the flange 44 and the upper end of the looped wall 17. Thus, when the covering layer 45 vibrates, air is reliably prevented from leaking from or entering into the air chamber 46 through between the covering layer 45 and the looped wall 17. As a result, the covering layer 45 more easily vibrates, and the vibration is easily converted into thermal energy, so that the intake noise is effectively reduced.

The upper end of the looped wall 17 and the flange 44 of the sound absorbing member 41 may be fixed to each other by welding.

The shapes of the fixing ribs 16A and 16B, the reinforcing rib 19, and the sound absorbing member 41 may be determined such that the upper end of the reinforcing rib 19 and the lower surface of the sound absorbing member 41 contact each other. With this configuration, the reinforcing rib 19 is caused to contact the sound absorbing member 41 when being installed. The reinforcing rib 19 thus functions as a member that determines the position of the sound absorbing member 41. The reinforcing rib 19 also functions as a stopper member that determines the maximum deformation position of the sound absorbing member 41.

In addition to providing the covering layer 45 on the outer surface of the sound absorbing member 41, a covering layer made of an air permeable material may be provided also on the inner surface of the sound absorbing member 41. In this case, the covering layer 45 on the outer surface of the sound absorbing member 41 and the covering layer on the inner surface of the sound absorbing member 41 may have different air permeabilities. When the air permeability of a covering layer is changed, the frequency at which the covering layer resonates changes. Thus, the frequency components the sound pressure level of which can be effectively reduced also change. Specifically, if the other conditions are the same, the lower the air permeability of the covering layer, the lower becomes the resonance frequency of the covering layer. Accordingly, frequency components the sound pressure level of which can be effectively reduced become lower frequency components. Therefore, by providing covering layers having different air permeabilities on the inner surface and the outer surface of the sound absorbing member 41 like the air cleaner described above, it is possible to effectively reduce the sound pressure levels of different frequency components, respectively, so that the intake noise is more effectively reduced.

The covering layer 45 may be omitted.

Two or more air chambers equivalent to the air chamber 46 may be provided in the air cleaner. In this case, the air chambers may have different volumes. When the volume of an air chamber is changed, the frequency at which the covering layer resonates changes. Thus, the frequency components the sound pressure level of which can be effectively reduced also change. Specifically, if the other conditions are the same, the larger the volume of the air chamber, the lower becomes the resonance frequency of the covering layer. Accordingly, the frequency components the sound pressure level of which can be effectively reduced become lower frequency components. Therefore, by providing air chambers having different volumes like the air cleaner described above, it is possible to effectively reduce the sound pressure levels of different frequency components, respectively, so that the intake noise is more effectively reduced.

The vibration reducing structure may be arranged on the peripheral wall 13 of the first housing 10 or on the peripheral wall 23 and the top wall 24 of the second housing 20.

What is claimed is:

1. An air cleaner comprising:

a first housing including an inlet and an opening;

a second housing including an outlet and an opening; and a filter element arranged between the opening of the first housing and the opening of the second housing, wherein at least one of the first housing and the second housing includes a looped fixing rib, which protrudes from an inner surface thereof, and a sound absorbing member, which is made of an air permeable material and fixed to an upper end of the fixing rib, the inner surface of the at least one of the housings, an inner peripheral surface of the fixing rib, and the sound absorbing member define an air chamber, and an air permeability of a peripheral portion of the sound absorbing member is set to be lower than an air permeability of the sound absorbing member in a central portion.

2. The air cleaner according to claim 1, further comprising a covering layer, which is made of a material having a lower air permeability than that of the sound absorbing member, wherein the covering layer is provided on at least one of an outer surface and an inner surface of the sound absorbing member in the air chamber.

3. The air cleaner according to claim 2, wherein the covering layer covers the entire outer surface of the sound absorbing member, and the peripheral portion of the sound absorbing member is fixed to the upper end of the fixing rib.

4. The air cleaner according to claim 2, wherein the sound absorbing member and the covering layer are both made of nonwoven fabric.

5. The air cleaner according to claim 1, further comprising a reinforcing rib provided in the air chamber, wherein the reinforcing rib protrudes from the inner surface of the at least one of the housings and has an upper end that is separated from the sound absorbing member.

6. The air cleaner according to claim 1, wherein the peripheral portion of the sound absorbing portion is fixed to the upper end of the fixing rib.

* * * * *